US010470630B2

(12) United States Patent
Sauer et al.

(10) Patent No.: US 10,470,630 B2
(45) Date of Patent: Nov. 12, 2019

(54) VACUUM CLEANER ROBOT

(71) Applicant: Eurofilters Holding N.V., Overpelt (BE)

(72) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 0 days.

(21) Appl. No.: 15/544,391

(22) PCT Filed: Dec. 11, 2015

(86) PCT No.: PCT/EP2015/079461
§ 371 (c)(1),
(2) Date: Jul. 18, 2017

(87) PCT Pub. No.: WO2016/116218
PCT Pub. Date: Jul. 28, 2016

(65) Prior Publication Data

US 2018/0020894 A1 Jan. 25, 2018

(30) Foreign Application Priority Data

Jan. 20, 2015 (EP) ..... 15151741
Jan. 20, 2015 (EP) ..... 15151742
Apr. 8, 2015 (EP) ..... 15162704

(51) Int. Cl.
*A47L 9/02* (2006.01)
*A47L 9/28* (2006.01)
(Continued)

(52) U.S. Cl.
CPC ..... *A47L 9/0494* (2013.01); *A47L 5/22* (2013.01); *A47L 9/009* (2013.01); *A47L 9/02* (2013.01);
(Continued)

(58) Field of Classification Search
CPC ..... A47L 2201/00–06; A47L 9/2873; A47L 9/2884; A47L 9/0494; A47L 9/2852;
(Continued)

(56) References Cited

U.S. PATENT DOCUMENTS 2,036,056 A 3/1936 Kroenlein
2,101,390 A 12/1937 Gorissen
(Continued)

FOREIGN PATENT DOCUMENTS

CA 2 498 435 A1 8/2006
CN 1164825 A 11/1997
(Continued)

OTHER PUBLICATIONS

Standard EN 60312-1-1 entitled Vacuum cleaners for household use Part 1-1: Cordless dry vacuum cleaners—Methods for measuring the performance (IEC 59F/257/CDV); Jul. 15, 2014; 20 pages.
(Continued)

*Primary Examiner* — David Redding
(74) *Attorney, Agent, or Firm* — Brinks Gilson & Lione

(57) ABSTRACT

The invention relates to a vacuum cleaner robot comprising a suction device mounted on wheels and a power supply device mounted on wheels, where the suction device comprises a floor nozzle, a dust separator and a motorized fan unit for suctioning an air stream in through the floor nozzle, where the suction device comprises a drive device for driving at least one of the wheels of the suction device, and where the power supply device comprises a drive device for driving at least one of the wheels of the power supply device, (Continued)

Figure 1:
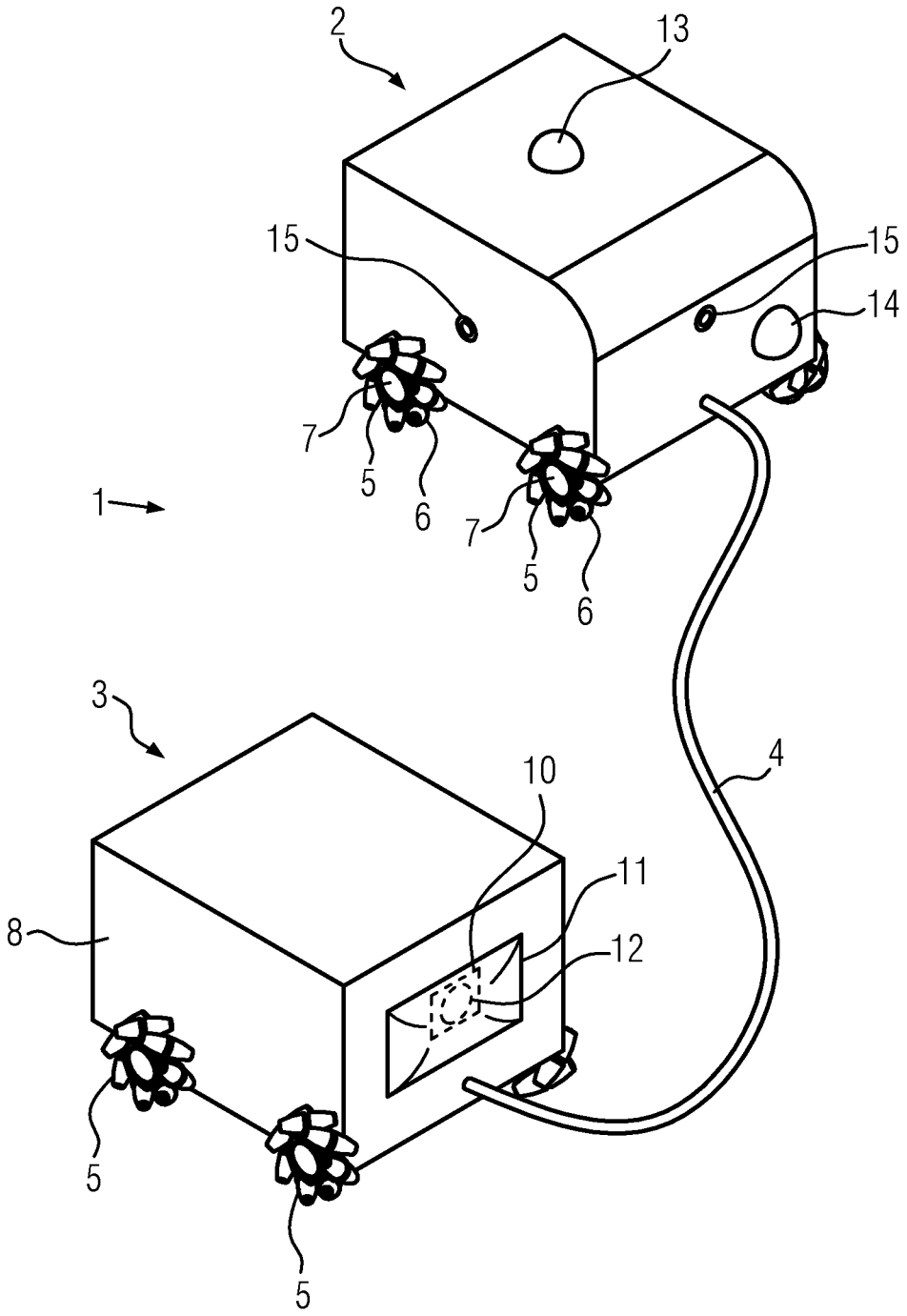

where said power supply device is via a power supply cable connected to said suction device for supplying said suction device with power.

18 Claims, 3 Drawing Sheets

(51) Int. Cl.
*A47L 5/22* (2006.01)
*A47L 9/00* (2006.01)
*A47L 9/14* (2006.01)
*A47L 9/04* (2006.01)

(52) U.S. Cl.
CPC ..... *A47L 9/0477* (2013.01); *A47L 9/1445* (2013.01); *A47L 9/28* (2013.01); *A47L 9/2821* (2013.01); *A47L 9/2842* (2013.01); *A47L 9/2852* (2013.01); *A47L 9/2868* (2013.01); *A47L 9/2873* (2013.01); *A47L 9/2884* (2013.01); *A47L 9/2894* (2013.01); *A47L 2201/00* (2013.01); *A47L 2201/022* (2013.01); *A47L 2201/04* (2013.01); *A47L 2201/06* (2013.01)

(58) Field of Classification Search
CPC .... A47L 9/1445; A47L 9/2842; A47L 9/2894; A47L 9/009; A47L 5/22; A47L 9/2868; A47L 9/2821; A47L 9/28; A47L 9/0477; A47L 9/02; A47L 2201/06; A47L 2201/022; A47L 2201/04
See application file for complete search history.

(56) References Cited

U.S. PATENT DOCUMENTS

| | | | | |
|---|---|---|---|---|
| 2,482,337 | A | 9/1949 | Hahn | |
| 3,876,255 | A | 4/1975 | Ilon | |
| 4,519,112 | A | 5/1985 | Bevington et al. | |
| 4,644,606 | A | 2/1987 | Luerken et al. | |
| 5,573,369 | A | 11/1996 | Du | |
| 5,815,880 | A | 10/1998 | Nakanishi | |
| 6,171,054 | B1 | 1/2001 | Mann, III et al. | |
| 6,519,804 | B1 * | 2/2003 | Vujik | A47L 5/32 15/331 |
| 6,719,830 | B2 | 4/2004 | Illingworth et al. | |
| 6,925,679 | B2 * | 8/2005 | Wallach | A47L 5/36 15/319 |
| 9,510,715 | B2 * | 12/2016 | Van Den Bogert | A47L 5/362 |
| 2002/0159897 | A1 | 10/2002 | Kegg et al. | |
| 2003/0202890 | A1 | 10/2003 | Bundy | |
| 2004/0200505 | A1 * | 10/2004 | Taylor | A47L 9/26 134/18 |
| 2004/0211318 | A1 | 10/2004 | Morgan | |
| 2005/0083011 | A1 * | 4/2005 | Yang | A47L 9/00 320/107 |
| 2005/0278888 | A1 * | 12/2005 | Reindle | A47L 9/2842 15/319 |
| 2006/0191098 | A1 | 8/2006 | Hiebert | |
| 2007/0272463 | A1 | 11/2007 | Yu et al. | |
| 2010/0256812 | A1 | 10/2010 | Tsusaka et al. | |
| 2011/0202224 | A1 * | 8/2011 | Thompson | G05D 1/0227 701/26 |
| 2013/0292918 | A1 | 11/2013 | Schlee et al. | |

FOREIGN PATENT DOCUMENTS

| | | | |
|---|---|---|---|
| CN | 1041672 | C | 1/1999 |
| CN | 1013 84973 | A | 3/2009 |
| CN | 203000795 | U | 6/2013 |
| CN | 1033 69995 | A | 10/2013 |
| DE | 298 03 415 | U1 | 6/1998 |
| DE | 298 12 377 | U1 | 10/1998 |
| DE | 20 2004 002284 | U1 | 8/2004 |
| DE | 10 2008 019 976 | A1 | 10/2009 |
| DE | 10 2008 046942 | A1 | 3/2010 |
| DE | 10 2011 083 319 | A1 | 3/2013 |
| DE | 20 2013 008 870 | U1 | 12/2013 |
| DE | 10 2013 100 192 | A1 | 7/2014 |
| EP | 1 360 922 | A2 | 11/2003 |
| EP | 2 030 551 | | 3/2009 |
| EP | 2 420 169 | A1 | 2/2012 |
| EP | 2 420 171 | A1 | 2/2012 |
| EP | 2 741 483 | A2 | 6/2014 |
| EP | 2 979 742 | A1 | 2/2016 |
| EP | 3 047 771 | A1 | 7/2016 |
| FR | 2 847 791 | A1 | 6/2004 |
| GB | 139 892 | A | 3/1920 |
| GB | 419 191 | A | 11/1934 |
| GB | 554 177 | A | 5/1941 |
| GB | 2 344 750 | A | 6/2000 |
| JP | H07 320 | A | 1/1995 |
| JP | 2005 027829 | A | 2/2005 |
| KR | 2005 0069018 | A | 7/2005 |
| KR | 2006 0034851 | A | 4/2006 |
| WO | WO 2002/058527 | A1 | 8/2002 |
| WO | WO 2002/074150 | A1 | 9/2002 |
| WO | WO 2007/068444 | A1 | 6/2007 |
| WO | WO 2007/093926 | A1 | 8/2007 |
| WO | WO 2007/117095 | A1 | 10/2007 |
| WO | WO 2008/002027 | A1 | 1/2008 |

OTHER PUBLICATIONS

Chinese Office Action dated Apr. 2, 2019 in Chinese Application No. 201580072355.4.

* cited by examiner

VACUUM CLEANER ROBOT

This application claims the benefit under 35 U.S.C. § 371 of International Application No. PCT/EP2015/079461, filed Dec. 11, 2015, which claims the benefit of European Patent Application No. 15151742.2, filed Jan. 20, 2015; European Patent Application No. 15151741.4, filed Jan. 20, 2015; and European Patent Application No. 15162704.9, filed Apr. 8, 2015; which are incorporated by reference herein in their entirety.

The invention relates to a vacuum cleaner robot.

Conventional vacuum cleaners are operated by a user who moves the vacuum cleaner, and in particular the floor nozzle through which dust is suctioned, across the surface to be cleaned. Conventional floor vacuum cleaners there comprise, for example, a housing which is mounted on rollers and/or runners. A dust collection container is arranged in the housing and contains a filter bag. A floor nozzle is via a suction tube and a suction hose connected to the dust collection chamber. In conventional floor vacuum cleaners, a motorized fan unit is further arranged in the housing and creates a negative pressure in the dust collection container. In the air flow direction, the motorized fan unit is therefore arranged downstream of the floor nozzle, the suction tube, the suction hose, and the dust collection container or the filter bag, respectively. Since cleaned air passes though such motorized fan units, they are sometimes referred to as clean air motors.

Particularly in former times, there were also vacuum cleaners in which the suctioned dirty air was passed directly through the motor fan and into a dust bag directly attached downstream. Examples thereof are shown in U.S. Pat. Nos. 2,101,390, 2,036,056 and 2,482,337. These forms of vacuum cleaners are nowadays no longer very common.

Such dirty air or fouled air motor fans are also referred to as a "dirty air motor" or "direct air motor". The use of such dirty air motors is also described in documents GB 554 177, U.S. Pat. Nos. 4,644,606, 4,519,112, US 2002/0159897, U.S. Pat. No. 5,573,369, US 2003/0202890 or U.S. Pat. No. 6,171,054.

In recent years, vacuum cleaner robots have also gained popularity. Such vacuum cleaner robots no longer have to be guided by a user over the surface to be cleaned; they instead drive autonomously across the floor. Examples of such vacuum cleaner robots are known, for example, from EP 2 741 483, DE 10 2013 100 192 and US 2007/0272463.

The drawback of these known vacuum cleaner robots is that they have only low dust absorption. This is due to the fact that either the dust absorption is achieved only by the brushing effect of a rotating brush roller, or motorized fan units with very low power are used.

An alternative vacuum cleaner robot is described in WO 02/074150. This vacuum cleaner robot is structured in two parts and comprises a container or fan module and a cleaning head module which is connected to the fan module via a hose.

Against this background, the object underlying the invention is to provide an improved vacuum cleaner robot. This object is satisfied with the subject matter of claim 1. A vacuum cleaner robot is provided according to the present invention comprising a suction device mounted on wheels and a power supply device mounted on wheels, where the suction device comprises a floor nozzle, a dust separator and a motorized fan unit for suctioning an air stream in through the floor nozzle, where the suction device comprises a drive device for driving at least one of the wheels of the suction device, and where the power supply device comprises a drive device for driving at least one of the wheels of the power supply device, where the power supply device is via a power supply cable connected to the suction device for supplying the suction device with power.

Due to the structure of the vacuum cleaner robot with a suction device on the one hand and a power supply device on the other hand, a vacuum cleaner robot of versatile use is obtained. Since the dust separator is provided on the side of the suction device, a suction hose connection between the suction device and the power supply device can be avoided. Power supply to the suction device is provided by the (autonomously movable) power supply device. Therefore, the suction device need not comprise its own rechargeable batteries and can therefore be formed to be compact and have less weight. Movability of the suction device is thereby overall improved. The suction device module can reach the surfaces to be suctioned even in confined conditions.

The suction device and the power supply device are designed as independent or (spatially) separate units; they are each mounted separately on their own wheels. The suction device and the power supply device are movable independently of one another. In particular, they can be connected to one another only by way of the power supply cable.

The motorized fan unit can be arranged between the floor nozzle and the dust separator such that an air stream suctioned in through the floor nozzle flows through the motorized fan unit into the dust separator.

A dirty air motor or direct air motor is thereby advantageously used in a vacuum cleaner robot. Even with low engine power, a high volumetric flow can be obtained with the vacuum cleaner robot according to the invention and thereby a high cleaning effect on carpets and hard floors. A dirty air motor, for example, has a maximum rotational speed of less than 30,000 rpm and an electrical input power of less than 900 W.

The floor nozzle, sometimes also referred to as a "suction nozzle", is in the suction device in the direction of air flow arranged (fluidically) upstream of the motorized fan unit, and the motorized fan unit is arranged upstream of the dust separator. The air suctioned in by the motorized fan unit through the floor nozzle is passed through the motorized fan unit and into the dust separator. Due to the fluidic connection, a continuous air stream is ensured from the floor nozzle into the dust separator.

It has surprisingly been found that dirty air motors can also be advantageously used in vacuum cleaner robots, in particular in order to convey dirty air suctioned in through the floor nozzle through the motorized fan unit into the dust separator.

Unlike in conventional vacuum cleaner robots with motorized fan units, in which negative pressure prevails during operation in particular in the dust collector unit or the dust collection chamber, respectively, this arrangement has an overpressure in the suction device that is fluidically downstream of the motorized fan unit, in particular in the dust separator. This leads to a simplified and weight-reduced construction of the suction device. It is in particular no longer necessary to provide a housing with reinforced side walls, for example with reinforcing ribs.

In an alternative to an above-described, the motorized fan unit can also be arranged fluidically downstream of the dust separator such that an air stream suctioned in through the floor nozzle flows through the dust separator into the motorized fan unit. In this alternative, in particular a clean air motor is used.

In the vacuum cleaner robots described, the power supply device can comprise a cordless power supply or a cordless voltage source, respectively. The power supply device can comprise one or more rechargeable batteries. Both the power supply device itself as well as the suction device are supplied with power or current via these rechargeable batteries.

The suction device can have three or four wheels, in particular precisely three or precisely four wheels. The drive device of the suction device can be configured to drive one of the wheels, several or all of the wheels of the suction device. For each drivable wheel, the drive device can have a separate or independent drive unit. This allows for independent or autonomous driving of each wheel.

The power supply device can have three or four wheels, in particular precisely three or precisely four wheels. The drive device of the power supply device can be configured to drive one of the wheels, several or all the wheels of the power supply device For each drivable wheel, the drive device can have a separate or independent drive unit. This allows for each wheel to be driven independently.

The drive device of the suction device can be (spatially) separated from the drive device of the power supply device or formed separately. In particular, the suction device and the power supply device can be driven independently of each other. They can be moved, for example, in different directions. Also, one of the two can not be moved while the other is moved.

In the above-described vacuum cleaner robots, the motorized fan unit can be arranged on and/or above the floor nozzle, in particular directly on and/or above the floor nozzle. This leads to advantageous suction performance. Moreover, a compact structure of the suction device can be obtained, in particular of the unit composed of the floor nozzle and the motorized fan unit. For example, the motorized fan unit can be arranged such that air suctioned through the floor nozzle enters the motorized fan unit directly from the floor nozzle.

The motorized fan unit can be fluidically connected to the floor nozzle via a tube member. In this case, the motorized fan unit is no longer arranged directly on and/or above the floor nozzle. The tube member can in particular have a length of 10 mm to 300 mm, preferably 10 mm to 100 mm.

In the above-described vacuum cleaner robots, the suction device can comprise a housing, where the motorized fan unit is arranged on, at or in the housing, and/or where the dust separator is arranged on, at or in the housing. The dust separator can be arranged fluidically directly upstream or directly downstream of the motorized fan unit. The dust separator can be fluidically connected to the motorized fan unit via a tube member. The tube member can in particular have a length of 10 mm to 300 mm, preferably 10 mm to 100 mm.

The housing can comprise a housing wall which is in particular made of plastic material.

In the above-described vacuum cleaner robots, the dust separator can be arranged to be freely accessible from the outside. In this case, the dust separator is not accommodated in a dust collection chamber in a housing. Instead, the dust separator can be arranged outside of a housing of the suction device, for example, on or at the housing. Alternatively, the suction device can also be designed without a housing. In this case, the dust separator can be arranged directly at the motorized fan unit or connected to it via a tube member. Free accessibility from the outside allows for easy and direct access to the dust collector, in particular for simple exchange or replacement of the latter. In the above-described vacuum cleaner robots, the power supply device or the suction device can comprise a cable drum with a winding spring. This allows for the cable to be wound up automatically. Alternatively, the power supply cable can be designed as a spiral cable. This also reduces the risk of entanglement of the cable during operation in the case of varying distances between the power supply device and the suction device.

In the above-described vacuum cleaner robots, one of the wheels, several or all wheels of the suction device and/or one of the wheels, several or all the wheels of the power supply device can be omnidirectional wheels. The use of omnidirectional wheels allows for very flexible and versatile movement of the suction device or the power supply device, respectively.

Each omnidirectional wheel on its circumference comprises a plurality of rotatably mounted rollers or roller bodies, the axes of which are not in parallel to the wheel axis (of the omnidirectional wheel). The axes of the rollers can in particular run or be oriented at an angle or transverse with respect to the wheel axis. An example of an omnidirectional wheel is a Mecanum wheel, which is described, inter alia, in U.S. Pat. No. 3,876,255.

The motorized fan unit can be configured in such a way that with aperture 8 it has a volumetric flow of more than 30 Vs, in particular of more than 35 Vs, at an electrical input power of less than 450 W according to DIN EN 60312-1. The motorized fan unit can alternatively or additionally be configured in such a way that with aperture 8 it has a volumetric flow of more than 25 Vs, in particular of more than 30 Vs, at an electrical input power of less than 250 W according to DIN EN 60312-1. The motorized fan unit can alternatively or additionally be configured in such a way that with aperture 8 it has a volumetric flow of more than 10 Vs, in particular of more than 15 Vs, at an electrical input power of less than 100 W according to DIN EN 60312-1.

In this way, a particularly efficient vacuum cleaner robot is obtained, which in particular has a greatly increased suction force as compared to conventional vacuum cleaner robots.

The air data of a vacuum cleaner or a motorized fan unit is determined according to DIN EN 60312-1: 2014-01. In particular section 5.8 is made reference to. Measuring device B according to section 7.3.7.3 is there used. If a motorized fan unit without a vacuum cleaner housing is measured, then measuring device B is likewise used. For possibly necessary adapters for connecting to the measuring chamber, the descriptions in section 7.3.7.1 apply.

The terms "volumetric flow" and "suction air flow" are also used for the term "air stream" according to DIN EN 60312-1.

The floor nozzle can comprise a floor plate with a base surface which during operation of the vacuum cleaner robot faces the surface to be suctioned, where the floor plate has at least one air flow channel parallel to the base surface, for example, with an opening provided laterally in the floor plate. In particular, the floor plate with its base surface can during operation of the vacuum cleaner robot rest on the surface to be suctioned or, for example, be spaced thereform by way of a bristle strip. The floor plate can comprise at least one curved air flow channel parallel to the base surface. The curved air flow channel can have the shape of a circular ring or a circular ring portion The floor plate is also referred to as a nozzle sole. The floor nozzle comprises a suction opening for producing a fluidic connection to the motorized fan unit. This suction opening is in fluidic connection with the at least one air flow channel. With the at least one, in particular, one or more air flow channels, the contact pressure of the floor nozzle is advantageously adjusted for good suction power.

The suction device can be configured and/or the motorized fan unit can be arranged such that no contact between the fan wheel of the motorized fan unit and a test probe according to IEC/EN 60335 is possible through the floor nozzle. Reference is there made to section 8 of the version DIN EN 60335-1: 2012-10. In particular, test probe B is to be used.

This reduces the risk of damaging the motorized fan unit and the risk of injury when touching the floor nozzle while the motor is running.

The vacuum cleaner robot can be a bag-type vacuum cleaner. A bag-type vacuum cleaner is a vacuum cleaner in which the suctioned dust is separated and collected in a vacuum cleaner impact. The vacuum cleaner robot can in particular be a bag-type vacuum cleaner for disposable bags.

In the vacuum cleaner robots described, the dust separator can comprise a vacuum cleaner filter bag, in particular with an area of at most 2000 $cm^2$, in particular at most 1500 $cm^2$. The dust separator can in particular consist of such a vacuum cleaner filter bag.

The filter area of a vacuum cleaner filter bag designates the entire area of the filter material which is located between or within the edge seams (for example welding or adhesive seams). Any side or surface folds that may be present also need to be considered. The area of the bag filling opening or inlet opening (including a seam surrounding this opening) is not part of the filter area.

The vacuum cleaner filter bag can be a flat bag or have a block bottom shape. A flat bag is formed by two side walls made of filter material which are joined together (for example welded or glued) along their peripheral edges. The bag filling opening or inlet opening can be provided in one of the two side walls. The side faces or walls can each have a rectangular basic shape. Each side wall can comprise one or more layers of nonwoven and/or nonwoven fabric.

The vacuum cleaner robot in the form of a bag-type vacuum cleaner can comprise a vacuum cleaner filter bag, where the vacuum cleaner filter bag is designed in the form of a flat bag and/or a disposable bag.

The bag wall of the vacuum cleaner filter bag can comprise one or more layers of a nonwoven and/or one or more layers of nonwoven fabric. It can in particular comprise a laminate of one or more layers of nonwoven and/or one or more layers of nonwoven fabric. Such a laminate is described, for example, in WO 2007/068444.

The term nonwoven fabric is used within the meaning of standard DIN EN ISO 9092:2010. In particular, film and paper structures, in particular filter paper, are there not regarded as being nonwoven fabric. "Nonwoven" is a structure made of fibers and/or continuous filaments or short fiber yarns shaped into a surface structure by some method (except interlacing of yarns such as woven fabric, knitwear, lace, or tufted fabric) but not bonded by some method. With a bonding process, a nonwoven turns into nonwoven fabric. The nonwoven or nonwoven fabric can be dry laid, wet laid or extruded.

The suction devices described can comprise a holder for a vacuum cleaner filter bag. Such a holder can be arranged on, at or in a housing of the suction device directly on the motorized fan unit or on a tube member fluidically connected to the motorized fan unit.

The vacuum cleaner robot can comprise a blow-out filter, in particular having a filter area of at least 800 $cm^2$. The blow-out filter can in particular be configured to be pleated or folded. This makes it possible to obtain a large surface area at a smaller base area. The blow-out filter can be provided in a holder, as described, for example, in European patent application No. 14179375.2. Such blow-out filters allow the use of vacuum cleaner filter bags with low separation efficiency, for example, of single-layer vacuum cleaner filter bags. For example, a bag can be used as a vacuum cleaner filter bag with low separation efficiency in which the filter material of the bag wall consists of a spunbond with a surface weight of 15 $g/m^2$ to 100 $g/m^2$. The vacuum cleaner filter bag can therefore be formed in particular having a single layer. For example, a bag can alternatively be used in which the filter material of the bag wall consists of a laminate made of a spunbond, a meltblown and a further spunbond (SMS).

The vacuum cleaner robots described above can have an outer bag or outer pouch which surrounds the dust separator or in which the dust separator is arranged. Such an outer bag is particularly advantageous in the case of a bag-type vacuum cleaner in which the vacuum cleaner filter bag is arranged to be freely accessible from the outside. The outer bag can fulfill a protective function and/or have noise-insulating and/or dust-filtering properties. The outer bag can comprise, for example, electret material.

Instead of a bag-type vacuum cleaner, the vacuum cleaner robot can be a bagless vacuum cleaner, in particular with a blow-out filter described above with a filter area of at least 800 $cm^2$. A bagless vacuum cleaner is a vacuum cleaner in which the suctioned dust is separated and collected without a vacuum cleaner filter bag. In this case, the dust separator can comprise an impact separator or a centrifugal separator or a cyclone separator, respectively.

The motorized fan unit can have an in particular single stage radial fan. With a radial fan, the air is suctioned in parallel or axially relative to the drive axis of the fan wheel and deflected by the rotation of the fan wheel, in particular by approximately 90°, and blown out radially.

In principle, the floor nozzle can be an active or a passive floor nozzle. An active floor nozzle has a brush roller (sometimes also referred to as a beating and/or rotation brush) in the suction opening. The brush roller can be driven electro-motorically A passive floor nozzle has no brush roller.

In the vacuum cleaner robots described, very good efficiency and suction performance can on account of the overall design also be obtained with a passive floor nozzle, i.e. without a brush roller. When using passive floor nozzles, the structure is simplified and the weight of the floor nozzle is thereby reduced, whereby the drive device of the floor nozzle has a lower power demand.

The vacuum cleaner robots described are designed for driving across a surface to be cleaned in an independent or autonomous manner.

The vacuum cleaner robots described above can comprise a control device for controlling the suction device and/or the power supply device. In particular, the control device can be designed to control the drive device of the power supply device and/or to control the drive device of the suction device. The control device can alternatively or additionally be designed to control the motorized fan unit.

The control device can be arranged exclusively in the power supply device, exclusively in the suction device or both in the power supply device and in the suction device. The control device can comprise two control units, where the suction device comprises a first control unit and the power supply device comprises a second control unit. If, however, the control device, for example, in the form of a control unit is arranged exclusively on the side of the power supply device, then also the suction device is controlled by the power supply device.

If the control device is arranged both in the power supply device and in the suction device, then it can have a master-slave configuration. For example, the control unit on the side of the power supply device can be designed as a master and can control the slave control unit on the side of the suction device.

The power supply device can comprise a wireless or a wired communication connection to the suction device for exchanging data signals with the suction device. This allows for efficient control of the entire vacuum cleaner robot from one of the two devices. For example, the suction device can be controlled from the power supply device, in particular where the power supply device comprises the entire control device.

If the power supply device has a wired communication connection to the suction device, then communication and power supply can be effected via a common cable. The common cable can comprise one or more lines for power supply and one or more lines for communication.

The vacuum cleaner robots described above can comprise a navigation device for autonomously driving the power supply device and/or the suction device. The control device can in particular comprise a navigation device for autonomously driving the power supply device and/or the suction device. This allows for autonomous vacuum cleaning by the vacuum cleaner robot. Control and navigation of the suction device can be effected exclusively by or on the side of the power supply device. In the vacuum cleaner robots described, the power supply device and/or the suction device can comprise one or several devices for determining the location.

The devices for determining the location can be, in particular, cameras, displacement sensors and/or distance sensors. The distance sensors can be based, for example, on sound waves or electromagnetic waves. The power supply device can comprise one or more devices for determining the location both of the power supply device and the suction device. The power supply device can alternatively or additionally comprise one or more devices for determining the location both of the power supply device and the suction device.

The power supply device can comprise a lifting device for adjusting the height of the underside of the power supply device, in particular the underside of the housing of the power supply device, above the floor. The distance between the underside of the power supply device or the floor clearance of the power supply device, respectively, can be adjusted therewith. For example, in a charging position of the vacuum cleaner robot, this allows to increase the height of the underside above the floor in order to drive the suction device beneath the power supply device or its housing.

Further features are described with reference to the figures, where

Figure 2:
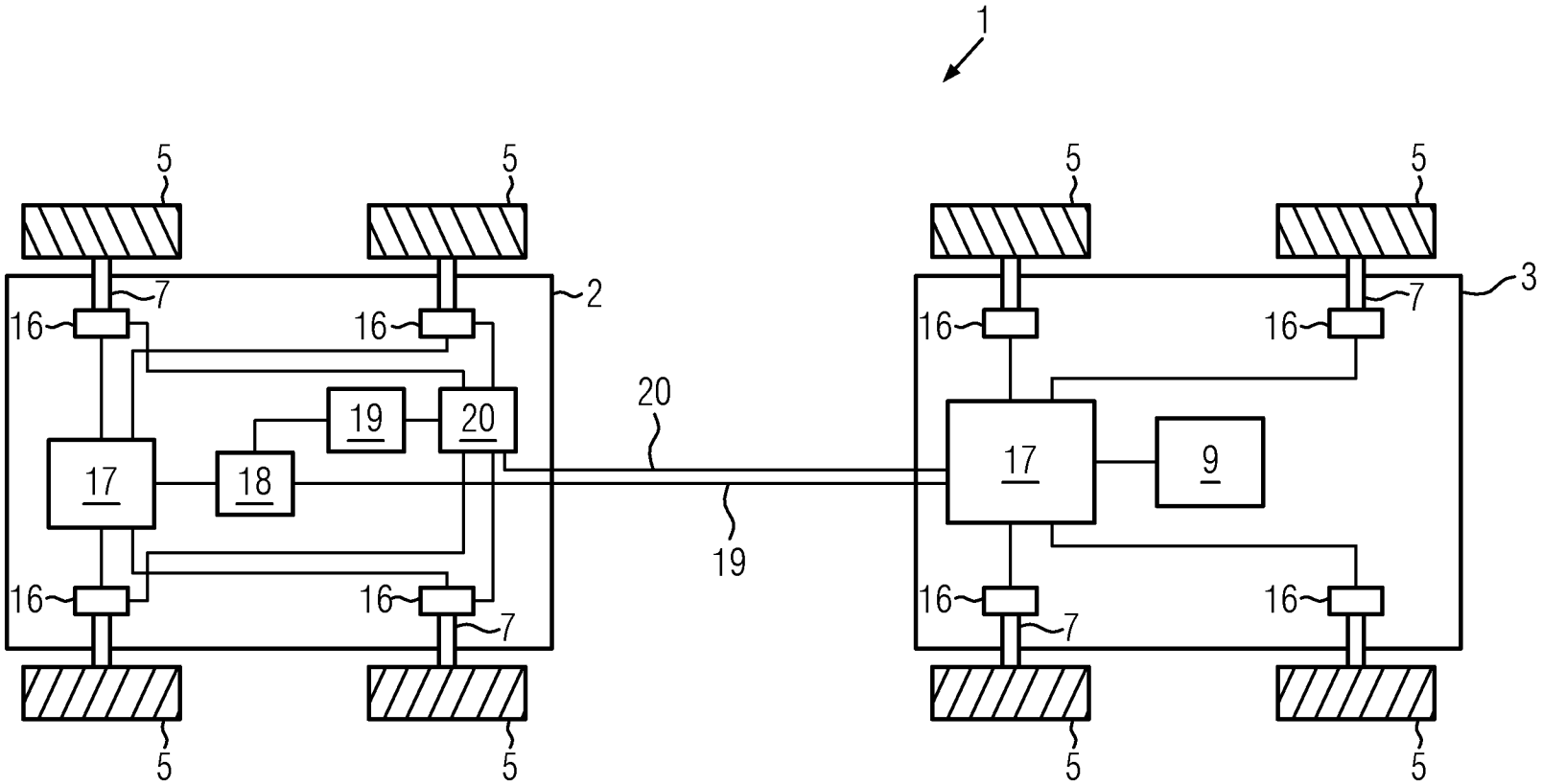
Figure 3:
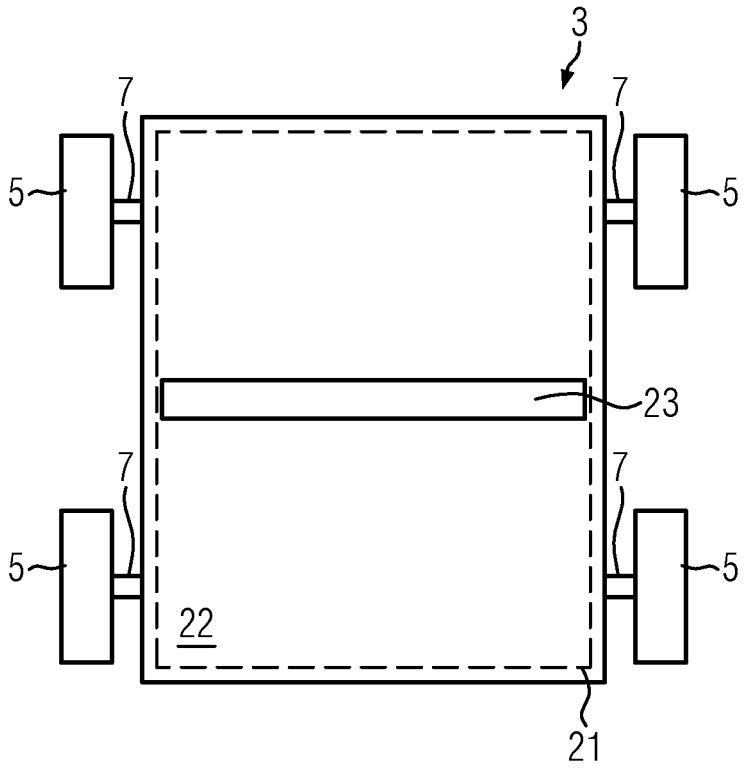

FIG. 1 schematically shows a first embodiment of a vacuum cleaner robot;

FIG. 2 schematically shows a block circuit diagram of an embodiment of a vacuum cleaner robot;

FIG. 3 schematically shows the underside of an embodiment of a suction device of a vacuum cleaner robot.

FIG. 1 is a schematic representation of a first embodiment of a vacuum cleaner robot 1. Vacuum cleaner robot 1 shown comprises a power supply device 2 and a suction device 3 which is connected to power supply device 2 via a flexible cable 4. Power supply device 2 is mounted on four wheels 5, each of which is formed as an omnidirectional wheel. Each omnidirectional wheel 5 has a plurality of rotatably mounted rollers 6 on its circumference. The rotational axes of rollers 6 are all not parallel to the wheel axis 7 of the respective omnidirectional wheel. For example, the rotational axes of the rollers can assume an angle of 45° relative to the respective wheel axis. The surfaces of the rollers or roller bodies are curved or bent.

Examples of such omnidirectional wheels are described in U.S. Pat. No. 3,876,255, US 2013/0292918, DE 10 2008 019 976 or DE 20 2013 008 870.

Power supply device 2 comprises a drive device for driving wheels 5 of the power supply device. The drive device can comprise a separate drive unit, for example, in the form of an electric motor, for each wheel 5 so that each wheel 5 can be driven independently of the other wheels. Rollers 6 are rotatably mounted without a drive.

By suitably driving individual or all wheels 5, power supply device 2 can be moved in any direction. If, for example, all four wheels 5 are moved at the same speed in the same direction of rotation, then the power supply device moves straight ahead. With a counter-rotating movement of the wheels on one side, a lateral movement or displacement can be achieved.

In principle, not all wheels need to be drivable; Individual wheels can also be provided without their own drive. In addition, it is also possible that individual wheels are not driven for certain movements, even if they are basically drivable.

In alternative embodiments, fewer or more than four wheels can also be formed in the form of omnidirectional wheels. An example with three omnidirectional wheels is described in US 2007/0272463.

In the example shown, suction device 3 is also equipped with four omnidirectional wheels 5. Like power supply device 2, suction device 3 also comprises a drive device for wheels 5. Here as well, the drive device for each wheel comprises a single drive unit, for example, in the form of electric motors, in order to drive each wheel separately and independently of the other wheels. In this way, the suction device can also be moved in any direction by suitably driving the wheels.

Suction device 3 has a floor nozzle 21 comprising a floor plate 22 with a base surface which during operation of the vacuum cleaner robot faces the floor, i.e. the surface to be suctioned. In the floor plate, one or more air flow channels 23 are incorporated parallel to the base surface, through which the dirty air is suctioned in. The air flow channel(s) 23 can comprise an opening provided laterally in the floor plate. The air flow channel can be straight or curved, in particular have the shape of a circular ring or a circular ring section. The shape of a circular ring section or of a circular ring can be advantageous in particular for lateral movements of the floor nozzle. Alternatively, the floor nozzle can comprise a rotation device for rotating the air flow channel about an axis perpendicular to the base surface, as described, for example, in European patent application no. 15151741.4.

Suction device 3 comprises a housing 8 in which a motorized fan unit is arranged for suctioning an air stream in through the floor nozzle. A holder for a holding plate 10 of a vacuum cleaner filter bag 11 is attached to the outer side of housing 8.

The example shown in FIG. 1 is therefore a bag-type vacuum cleaner. This means that the dust separator is a vacuum cleaner filter bag in which the suctioned dirt and dust is separated. This vacuum cleaner filter bag can be, in particular, a flat bag, the bag walls of which comprise one or more layers of nonwoven and/or nonwoven fabric. The vacuum cleaner filter bag is embodied as a disposable bag.

Holding plate 10 of vacuum cleaner filter bag 11 is glued or welded in a conventional manner to the non-woven filter material of the bag wall. An opening 12 is provided in housing 8 of suction device 3. A tube member is led from the motorized fan unit inside housing 8 into opening 12 so that the air suctioned in through the floor nozzle is passed through opening 12, through the motorized fan unit and into vacuum cleaner filter bag 11.

Attached in a removable manner in or on the holder by way of its holding plate 10 is vacuum cleaner filter bag 11. The holder can be, for example, two rails into which holding plate 10 is pushed. However, alternative embodiments are equally conceivable as long as the vacuum cleaner filter bag can be removed in a detachable and nondestructive manner.

In the example shown, vacuum cleaner filter bag 11 is arranged on housing 8 of suction device 3 to be freely accessible from the outside. Alternatively, vacuum cleaner filter bag 11 can also be removably attached in the interior of housing 8, for example, by way of a holding plate. In such a case, the vacuum cleaner filter bag is accessible, for example, via an opening flap in housing 8, but then is no longer freely accessible from the outside.

In the arrangement shown, a continuous fluidic connection to the dust separator in the form of a vacuum cleaner filter bag 11 is therefore established by the floor nozzle, the motorized fan unit, and the tube member located in the interior of the housing. The motorized fan unit is there arranged between the floor nozzle and the dust separator so that dirty air suctioned in through the floor nozzle flows through motorized fan unit 9 (in particular via the tube member) into the vacuum cleaner filter bag arranged on the exterior of housing 8.

Motorized fan unit 9 is therefore a dirty air motor. This is in particular a motorized fan unit comprising a radial fan.

The motorized fan unit has a volumetric flow of more than 30 l/s (determined according to DIN EN 60312-1: 2014-01, with an aperture of 8) at an electrical input power of less than 450 W, a volumetric flow rate of more than 25 l/s at an electrical input power of less than 250, and a volumetric flow of more than 10 l/s at an electrical input power of less than 100 W.

The fan diameter can be 60 mm to 160 mm. A motorized fan unit can be used, for example, which is used in Soniclean Upright vacuum cleaners (e.g. SONICLEAN VT PLUS).

The motorized fan unit of the SONICLEAN VT PLUS was characterized according to DIN EN 60312-1: 2014-01 as explained above. The motorized fan unit was measured without the vacuum cleaner housing. For possibly necessary adapters for connecting to the measuring chamber, the descriptions in section 7.3.7.1 apply. The table shows that high volumetric flows are obtained at low rotational speeds and low input power.

"Dirty air" of SONICLEAN VT PLUS (fan wheel diameter 82 mm) with aperture 8 (40 mm)

| Input power [W] | voltage [V] | rotational speed [RPM] | negative pressure box [kPa] | volumetric flow [l/s] |
|---|---|---|---|---|
| 200 | 77 | 15,700 | 0.98 | 30.2 |
| 250 | 87 | 17,200 | 1.17 | 32.9 |
| 300 | 95 | 18,400 | 1.34 | 35.2 |
| 350 | 103 | 19,500 | 1.52 | 37.5 |

-continued

"Dirty air" of SONICLEAN VT PLUS (fan wheel diameter 82 mm) with aperture 8 (40 mm)

| Input power [W] | voltage [V] | rotational speed [RPM] | negative pressure box [kPa] | volumetric flow [l/s] |
|---|---|---|---|---|
| 400 | 111 | 20,600 | 1.68 | 39.4 |
| 450 | 117 | 21,400 | 1.82 | 41.0 |

Air is during operation suctioned in by the motorized fan unit. The air stream there enters vacuum cleaner robot 1 through an opening of the floor nozzle and flows through the motorized fan unit. Due to the arrangement of the motorized fan unit—in the air stream direction—upstream of the dust separator (in the form of a vacuum cleaner filter bag), there is an overpressure in the dust separator.

Instead of a dirty air motor, a configuration (for example with a clean air motor) can also be provided in which the fan is arranged fluidically downstream of the dust separator.

The energy supply or voltage supply of the vacuum cleaner robot can be effected cordless by way of rechargeable batteries, where the power supply to suction device 3, in particular its drive device, is effected from power supply device 2 by way of power supply cable 4. In order to avoid entanglement of cable 4, a cable drum with a winding spring can be provided in the interior of power supply device 2.

Power supply device 2 comprises rechargeable batteries which can be charged, for example, by cable or in a cordless manner (inductive). For charging the rechargeable batteries, vacuum cleaner 1, in particular power supply device 2, can move autonomously to a charging station.

Controlling the vacuum cleaner robot is effected by way of a control device. The entire vacuum cleaner robot is preferably controlled in a master-slave configuration of the two devices. For this purpose, suction device 3 (as a slave) can also be controlled, for example, by power supply device 2 (as a master). The drive devices of the power supply device and the suction device are controlled by use of the control device.

The control device can comprise a navigation device for autonomously driving the power supply device and the suction device. For this purpose, power supply device 2 comprises a control unit with a navigation device with which navigation of both the power supply device and that of the suction device is performed. For this purpose, a correspondingly programmed microcontroller is arranged in control device 2. Power supply device 2 comprises devices for determining the location. They include cameras 13 and 14 as well as distance sensors 15. The distance sensors can be, for example, laser sensors Navigation of the vacuum cleaner robot occurs in a known manner, as described, for example, in WO 02/074150. Provided in power supply device 2 for controlling the drive device of suction device 3 is a device for transmitting control signals to suction device 3, in particular to its drive device. For this purpose, wireless transmitters/receivers can respectively be arranged on the side of power supply device 2 and suction device 3. Alternatively, a wired connection for transmitting control signals can also be provided in cable 4.

Suction device 3 can in a supporting manner also comprise one or more devices for determining the location. For example, path sensors and/or distance sensors can be provided at the suction device. In order to use the corresponding information for control and navigation, corresponding signals are transmitted from suction device 3 to power supply device 2.

In an alternative embodiment, control and/or navigation can also be effected in part or entirely on the side of suction device 3.

FIG. 2 is a schematic block circuit diagram of a vacuum cleaner robot 1 with a power supply device 2 and a suction device 3. The drive device for wheels 5 of power supply device 2 comprises, firstly, four drive units 16 in the form of electric motors and, secondly, a microcontroller 17 for controlling the electric motors.

Furthermore, a control unit 18 is provided in power supply device 2 and comprises a navigation device and serves controlling as well as autonomously driving both suction device 3 and power supply device 2. Control unit 18 is connected both to microcontroller 17 of the drive device as well as to a further microcontroller 19 which is part of the devices for determining the location on the side of the power supply device. Data signals from different sensors and/or cameras are processed in microcontroller 19 and made available to control unit 18.

In the example illustrated, power supply or voltage supply is effected by way of a rechargeable battery 20, which can be charged wirelessly or in a cabled manner. Charging can be effected at a charging station which is autonomously approached by the robot. In order to minimize the space requirement of the robot at the charging station, the suction device can be positioned beneath the power supply device during the charging or cleaning operation. For this purpose, the power supply device is by use of a lifting device automatically raised and floor clearance is thereby increased so that the suction device can drive therebeneath.

For the sake of clarity, not all power supply and data connections are shown in the figure.

Suction device 3 also comprises a drive device for its four wheels 5, where the drive device, like in the case of power supply device 2, comprises a microcontroller 17 and four electric motors 16. Control signals for the drive device of suction device 3 originate from control unit 18 which is arranged in power supply device 2. The signals are transmitted via a communication line 19 which can be arranged, for example, in the power supply cable. Alternatively, however, this signal transmission could also be effected wirelessly.

Motorized fan unit 9 is also controlled by microcontroller 17, where corresponding control signals are sent from control unit 18 of power supply device 2 to suction device 3.

Power and voltage supply of suction device 3 is effected via rechargeable battery 20 of power supply device 2. For this purpose, a line 20 is provided which is arranged in a power supply cable between power supply device 2 and suction device 3.

It is in the embodiments described in fact possible, but not necessary, that a brush roller (for example, a beating brush and/or a rotating brush) is provided on or in the floor nozzle.

The invention claimed is:

1. A vacuum cleaner robot, comprising a suction device mounted on wheels, a power supply device mounted on wheels and a power supply cable, where said suction device comprises a floor nozzle, a dust separator and a motorized fan unit for suctioning an air stream in through said floor nozzle, where said suction device comprises a drive device for driving at least one of said wheels of said suction device, and where said power supply device comprises a drive device for driving at least one of said wheels of said power supply device, where said power supply device is connected to said suction device via the power supply cable for supplying said suction device with power, where said motorized fan unit is arranged between said floor nozzle and said dust separator such that an air stream suctioned in through said floor nozzle flows through said motorized fan unit and into said dust separator, the dust separator comprising a vacuum cleaner filter bag, an impact separator, a centrifugal separator or a cyclone separator.

2. The vacuum cleaner robot according to claim 1, where said power supply device comprises a wireless or a wired communication connection to said suction device for exchanging data signals with said suction device.

3. The vacuum cleaner robot according to claim 1, where said motorized fan unit is arranged on or above said floor nozzle.

4. The vacuum cleaner robot according to claim 1, where said suction device comprises a housing, where said motorized fan unit is arranged on, at or in said housing or where said dust separator is arranged on, at or in said housing.

5. The vacuum cleaner robot according claim 1, where said dust separator is arranged to be freely accessible from outside.

6. The vacuum cleaner robot according to claim 1, where one of said wheels, several or all wheels of said suction device or one of said wheels, several or all wheels of said power supply device are omnidirectional wheels.

7. The vacuum cleaner robot according to claim 1, where said motorized fan unit is configured such that with aperture 8 said motorized fan unit has a volumetric flow of more than 30 l/s at an electrical input power of less than 450 W according to DIN EN 60312-1, with aperture 8 said motorized fan unit has a volumetric flow of more than 25 l/s at an electrical input power of less than 250 W according to DIN EN 60312-1, or with aperture 8 said motorized fan unit has a volumetric flow of more than 10 l/s at an electrical input power of less than 100 W according to DIN EN 60312-1.

8. The vacuum cleaner robot according to claim 1, where said dust separator comprises a vacuum cleaner filter bag.

9. The vacuum cleaner robot according to claim 8, where said vacuum cleaner filter bag comprises a flat bag or a disposable bag or where said bag wall of said vacuum cleaner filter bag comprises one or more layers of a nonwoven or one or more layers of nonwoven fabric.

10. The vacuum cleaner robot according to claim 1, where said motorized fan unit comprises a radial fan.

11. The vacuum cleaner robot according to claim 1, where said floor nozzle comprises no rotating brush.

12. The vacuum cleaner robot according to claim 1, comprising a control device for controlling said suction device or said power supply device.

13. The vacuum cleaner robot according to claim 1, comprising a navigation device for autonomously driving said power supply device or said suction device.

14. The vacuum cleaner robot according to claim 1, where said power supply device or said suction device comprises one or several devices for determining its respective location.

15. The vacuum cleaner robot according to claim 3, wherein said motorized fan unit is arranged directly on or above said floor nozzle.

16. The vacuum cleaner robot according to claim 8, wherein said vacuum cleaner filter bag comprises a filter area of at most 2000 $cm^2$.

17. The vacuum cleaner robot according to claim 1, comprising a control device for controlling said suction device and said power supply device.

18. The vacuum cleaner robot according to claim 1, where said power supply device and said suction device comprise one or several devices for determining its respective location.

* * * * *